United States Patent [19]

Metzger

[11] Patent Number: 4,759,405

[45] Date of Patent: Jul. 26, 1988

[54] AIR CONDITIONER CONDENSER MANIFOLD

[76] Inventor: Frederick W. Metzger, 6075 Pelican Bay Blvd., Dorchester 402, Naples, Fla. 33963

[21] Appl. No.: 27,634

[22] Filed: Mar. 18, 1987

[51] Int. Cl.[4] ..... F28F 9/02

[52] U.S. Cl. ..... 165/173; 165/176; 165/110; 228/170; 228/173.4; 228/183; 29/157.4

[58] Field of Search ..... 165/173, 175, 176, 110; 29/157.4, 157.6; 228/170, 173.4, 183

[56] References Cited

U.S. PATENT DOCUMENTS

| | | | |
|---|---|---|---|
| 1,278,243 | 9/1918 | Sonneborn | 165/175 |
| 2,816,738 | 12/1957 | McElgin | 165/176 X |
| 2,896,975 | 7/1959 | Wahl | 29/157.3 R |
| 3,238,606 | 3/1966 | Tolson | 228/183 X |
| 3,279,532 | 10/1966 | Pfeil, Jr. | 165/173 X |
| 3,307,622 | 3/1967 | Oddy | 165/175 X |
| 3,310,868 | 3/1967 | LaPorte et al. | 228/183 X |
| 3,689,972 | 9/1972 | Mosier et al. | 29/157.3 R |
| 4,615,385 | 10/1986 | Superstein et al. | 165/175 |

FOREIGN PATENT DOCUMENTS

| | | | |
|---|---|---|---|
| 0022235 | 1/1981 | European Pat. Off. | 165/173 |

*Primary Examiner*—Ira S. Lazarus
*Assistant Examiner*—Peggy Neils
*Attorney, Agent, or Firm*—Stonebraker, Shepard & Stephens

[57] ABSTRACT

An air conditioner condenser manifold uses a tube having a flat side and a semi-oval cross-sectional shape, with holes pierced into the flat side of the tube without removing any material from the tube. The material of the flat side of the tube within an indentation around each of the holes is formed into a cylindrical collar recessed into the tube and having an inside axial length longer than the unpierced thickness of the tube. The ends of smaller tubes are bonded into each of the collars so that bonding material is disposed in the indentations around the holes.

14 Claims, 1 Drawing Sheet

AIR CONDITIONER CONDENSER MANIFOLD

BACKGROUND

Manifolds for air conditioner condensers have been made by fastening plugs in ends and mid-regions of a cylindrical tube to divide the tube into chambers, and then punching and perforating holes along the length of the tube to receive the ends of smaller tubes, which are brazed or soldered into each hole. This suffers from many problems that have remained unsolved.

If the holes are formed in a cylindrical tube without first punching out a slug of material, the tube cracks during the forming process. Punching out a slug at each hole solves this problem, but requires removal of the slugs through the holes from which they were punched, because the tube contains the chambering plugs, which cannot be inserted after the holes are punched. Slug removal is not only expensive, but causes defective parts when unremoved slugs are left within the tube.

Cylindrical collars formed around the punched holes are thin, and often cracked and delaminated. They are sometimes not accurately round, and their open ends, recessed into the tube, are curved and irregular, rather than flat. The axial length of the inside cylindrical portion of the collars is also relatively short, and all these circumstances contribute to unreliable brazing or soldering so that joints leak. This is especially troublesome in automotive air conditioners that are subject to vibration.

I have devised a way of forming condenser manifolds to overcome these problems. My manifold has hole collars that are thicker, more uniform, extend their cylindrical insides for a longer axial length, and are uncracked and flat at their open ends so that joints with tube ends are much more reliable. My forming also does not produce any slugs that must be removed from inside the tube, and my manifold tubes are easier to work with. The overall result, is an air conditioner condenser manifold that performs better without costing more.

SUMMARY

I form my condenser manifold from a tube having a flat side and a semi-oval cross-sectional shape, and I pierce the flat side of the tube to form the necessary holes without removing slugs or other material from the tube. After fastening the chambering plugs in place within the tube, I pierce and form the holes, which indents the flat side of the tube around each hole as it is formed. The material of the flat side of the tube that is indented around each hole is formed into a cylindrical collar recessed into the tube from the flat side and having an inside axial length longer than the thickness of the tube wall. Tube ends can then be bonded into each of the collars with a bonding material that is disposed in the indentations around each of the holes. The open ends of the collars inside the tube are flat and parallel with the flat side of the tube, and the collars are uniformly thick and uncracked.

DRAWINGS

DETAILED DESCRIPTION

Instead of punching out slugs and forming holes in a cylindrical tube, as has previously been done in forming condenser manifolds, I form manifold 10 of a semi-oval tube 11 having a flat side 12 and an ovally curved side 13. Tube 11 can be extruded in the illustrated semi-oval shape or can be formed into that shape by rolling or stamping a cylindrical tube. The preferred material for tube 11 is aluminum, but other materials may also serve.

Figure 1:
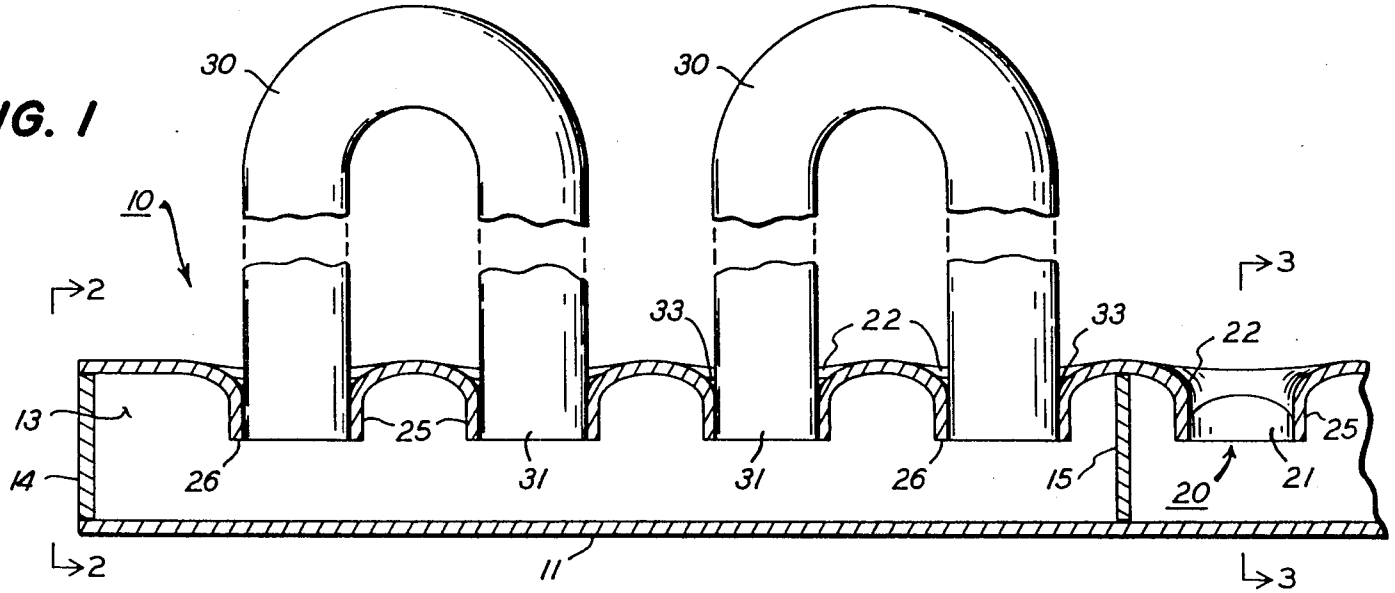
FIG. 1 is a longitudinally sectioned, fragmentary elevational view of a preferred embodiment of my air conditioner condenser manifold.

Before forming holes, I fasten in place the necessary end plugs 14 and chambering plugs 15 (one of each of these is shown in FIG. 1). Plugs 14 and 15 have a semi-oval shape fitting the inside of tube 11.

Figure 4:
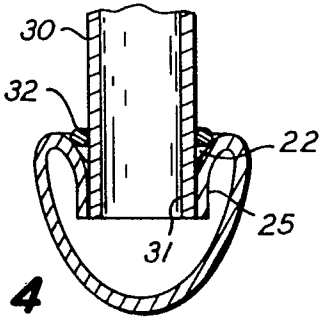
FIG. 4 is a cross-sectional view, similar to the view of FIG. 3, showing a solder ring positioned for soldering a tube end in place.
Figure 3:
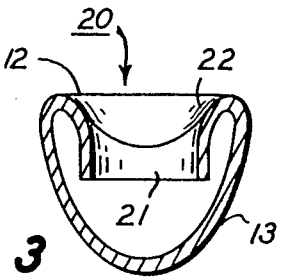
FIG. 3 is a cross-sectional view of the manifold tube of FIG. 1, taken along the line 3—3 thereof.
Figure 2:
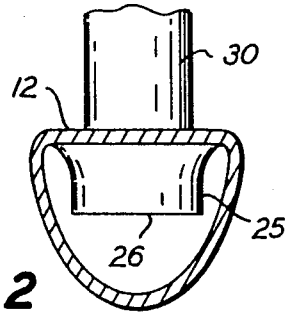
FIG. 2 is an end view of the manifold of FIG. 1, with the end plug removed.

I then pierce holes 20 in flat side 12 without first punching out a slug of material and without cracking flat side 12, or any other part of tube 11. I use a pointed piercing tool (not shown) having a cylindrical outside diameter forming the cylindrical inside surfaces 21 of holes 20. By piercing and forming the material available in flat side 12, without removing any slug, collars 25 around holes 20 can be made with uniformly thick and even walls that do not crack or delaminate and are thicker than collar walls attainable by punching out and forming holes in cylindrical tubes. As best shown in FIGS. 2–4, each of the cylindrical inside surfaces 21 has a diameter larger than one-half the width of flat side 12.

Each of the collars 25 around holes 20 receives and supports an end region 31 of a lateral tube 30, which is bent into a U-shape as illustrated. Tube ends 31 are soldered, brazed, or otherwise bonded into collars 25, whose roundness, strength, and uniformity is important for a secure bond and a leakfree joint with each tube end 31. As best shown in FIGS. 2 and 4, lateral tubes 30 have a diameter larger than half the width of flat side 12 and somewhat smaller than the maximum inside dimension of tube 11.

With adequate material available for forming collars 25, cylindrical inside surfaces 21 extend for a greater axial length than has been possible for collars formed around holes punched in cylindrical tubing. This helps a great deal in supporting tube ends 31 and securing reliable bonds. The axial length of cylindrical inside surface 21 is longer in a plane transverse to tube 11 than in a plane running axially of tube 11, but even in the axial plane, inside surface 21 is longer than the inside surfaces of collars formed around holes punched in cylindrical tubing. The longer axial length of surfaces 21 provides a larger support and bonding area for tube ends 31, to ensure leakfree joints. The open ends 26 of collars 25 are also flat and parallel with flat side 12 to conform with the square shape of tube ends 31. Collars previously formed in cylindrical tubes had curved open ends that were relatively thin and often cracked and delaminated. My collars 25, with their thicker walls and ends 26 that do not crack or delaminate, provide a stronger support for the larger bonding area.

My forming operation recesses holes 20 and collars 25 relative to flat side 12 and forms an indentation 22 around the flared entry to each collar 25. Indentations 22 further add to the strength of the bond with tube ends 31. A ring 32 of solder or brazing material, as shown in FIG. 4 can be positioned in indentation 22 around tube end 31 inserted into collar 25. In this position the brazing or solder ring 32 can be heated and flowed into collar 25 to bond tube end 31 securely in place, leaving a gusset 33 of solder or bonding material in each indentation 22, as shown in FIG. 1. This braces and improves the reliability of the bonded joints.

The presence of flat side 12 on tube 11 also has some practical advantages during manufacture of manifold 10. It can serve as a location surface in jigs or fixtures usable in manufacturing processes, and this can make tube 11 easier to locate and position accurately than previously used cylindrical tubes.

I claim:

1. An automotive condenser manifold comprising:

a. an aluminum tube having a flat side and a semi-oval cross-sectional shape;

b. the aluminum material of said flat side being pierced and formed into a plurality of circular holes indented into said flat side without removal of material from said flat side;

c. said circular holes having a diameter larger than one-half the width of said flat side;

d. said material of said flat side around each of said holes being formed into a cylindrical collar recessed into said tube from said flat side and having an inside axial length longer than the unpierced thickness of said material of said flat side; and e. open ends of said collars inside said tube being flat and parallel with said flat side of said tube.

2. The condenser manifold of claim 1 wherein a cylindrical tube end is bonded into each of said collars so that bonding material is disposed in indentations around each of said holes.

3. The condenser manifold of claim 1 wherein end plugs and central plugs dividing said tube into chambers have a semi-oval shape fitting an inside surface of said tube.

4. The condenser manifold of claim 1 wherein said collars are uniformly thick and uncracked.

5. An automotive condenser manifold forming method comprising:

a. forming an aluminum tube with a flat side and a semi-oval cross-sectional shape; and b. piercing said flat side of said tube to form a plurality of circular holes without removing material from said tube, said piercing being performed so as to indent said flat side around each of said holes and to form each of said holes with a cylindrical collar recessed into said tube from said flat side and having an inside axial length longer than the unpierced thickness of said flat side and having a diameter larger than one-half the width of said flat side.

6. The method of claim 5 including inserting tube ends into each of said collars and bonding said tube ends in said collars with bonding material disposed in the indentations around each of said holes.

7. The method of claim 5 including performing said piercing so that open ends of said collars within said tube are flat and parallel with said flat side.

8. The method of claim 5 including performing said piercing so that said collars are uniformly thick and without cracks.

9. The method of claim 5 including securing chambering plugs in a semi-oval shape within said tube before piercing said holes.

10. An automotive condenser manifold comprising:

a. an aluminum tube with a flat side in which a plurality of circular holes are pierced without removing material from said tube, said circular holes having a diameter larger than one-half the width of said flat side;

b. the aluminum material of said flat side being formed into uniformly thick and uncracked cylindrical collars around each of said holes, said collars having an inside axial length longer than the unpierced thickness of said flat side; and c. said collars being indented into said tube from said flat side, and open ends of said collars being flat and parallel with said flat side.

11. The condenser manifold of claim 10 wherein said tube has a semi-oval cross-sectional shape including said flat side.

12. The condenser manifold of claim 10 wherein tube ends are bonded into each of said collars so that bonding material is disposed in indentations around said collars.

13. The condenser manifold of claim 11 including chamber division plugs in a semi-oval cross-sectional shape secured within said tube.

14. The condenser manifold of claim 13 wherein tube ends are bonded into each of said collars so that bonding material is disposed in indentations around said collars.

* * * * *